US006858823B1

(12) United States Patent
Bedard et al.

(10) Patent No.: US 6,858,823 B1
(45) Date of Patent: Feb. 22, 2005

(54) INFRARED HEATER USING ELECTROMAGNETIC INDUCTION

(75) Inventors: Normand Bedard, Trois-Rivieres-Ouest (CA); Michel Dostie, Trois-Rivieres-Ouest (CA)

(73) Assignee: Hydro-Quebec, Montreal (CA)

( * ) Notice: Subject to any disclaimer, the term of this patent is extended or adjusted under 35 U.S.C. 154(b) by 107 days.

(21) Appl. No.: 10/030,990

(22) PCT Filed: Jun. 15, 2000

(86) PCT No.: PCT/CA00/00722

§ 371 (c)(1),
(2), (4) Date: Sep. 3, 2002

(87) PCT Pub. No.: WO01/06814

PCT Pub. Date: Jan. 25, 2001

(30) Foreign Application Priority Data

Jul. 16, 1999 (CA) ..... 2277885

(51) Int. Cl.[7] ..... H05B 6/10

(52) U.S. Cl. ..... 219/618; 219/622; 219/634; 219/649; 219/670

(58) Field of Search ..... 219/618, 622, 219/634, 635, 649, 670, 672, 675, 676, 677

(56) References Cited

U.S. PATENT DOCUMENTS

| | | | | |
|---|---|---|---|---|
| 2,635,168 A | | 4/1953 | Lerza et al. | |
| 5,227,597 A | * | 7/1993 | Dickens et al. | 219/621 |
| 5,240,542 A | * | 8/1993 | Miller et al. | 156/272.4 |
| 5,528,020 A | * | 6/1996 | Dickens et al. | 219/621 |

FOREIGN PATENT DOCUMENTS

| | | |
|---|---|---|
| BE | 497 198 | 11/1950 |

* cited by examiner

*Primary Examiner*—Philip H. Leung
(74) *Attorney, Agent, or Firm*—Oblon, Spivak, McClelland, Maier & Neustadt, P.C.

(57) ABSTRACT

The invention concerns a heater made of a material (5) responsive to induction and capable of sustaining high temperatures. It further comprises at least an insulating thickness with low thermal conductivity, in particular a low temperature insulation (3) and a high temperature insulation (4), said thickness being fixed at the back of the material. A field winding (2) is adjacent to the insulating thickness and separated from the material (5) by the latter.

15 Claims, 1 Drawing Sheet

INFRARED HEATER USING ELECTROMAGNETIC INDUCTION

TECHNICAL FIELD

Figure 1:
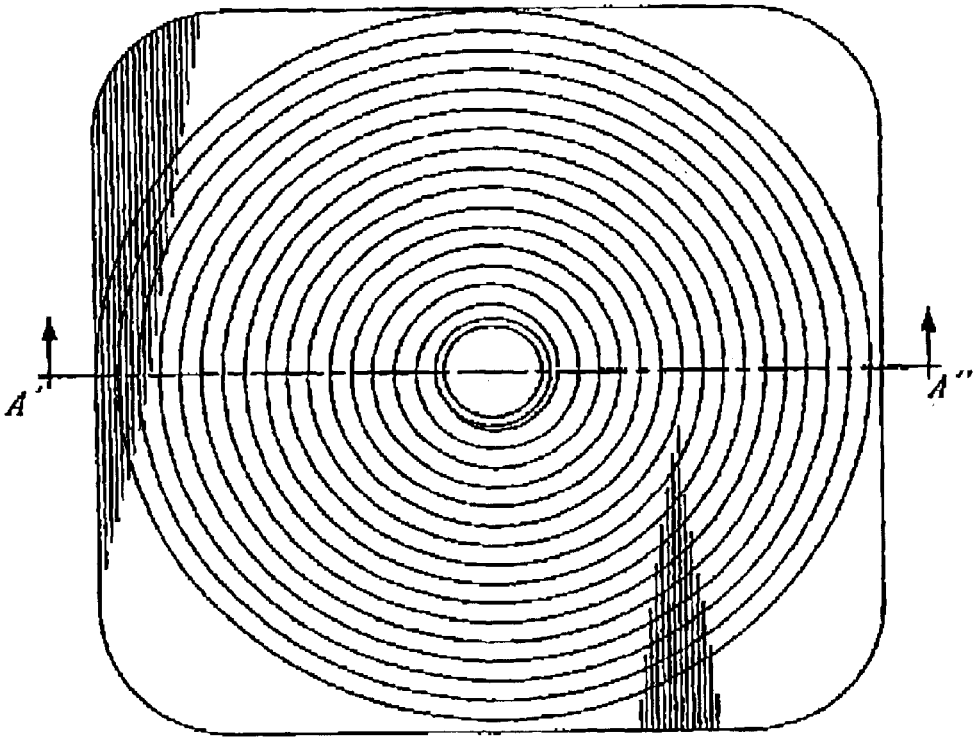

The invention concerns an infrared heater using electromagnetic induction. More particularly, the invention relates to a device capable of emitting infrared radiation, said device being electrically supplied by means of an inductor and characterized by a choice of material for the heater that is adapted to withstand high temperatures allowing to reach high infrared power density in the medium wavelength range.

PRIOR ART

In most of the many applications of electrical infrared, the power density needed with the process is relatively low. On the other hand, some processes such as coated paper drying in the pulp and paper industry require the use of technologies with very high power density. This requirement is due to the fact that machines are running sheets of paper at high speeds and evaporation rate is relatively high.

Most of the infrared applications in the field of pulp and paper industry concern coating drying. Infrared is used for drying coating slips on the sheet of paper, mainly since 1985 [Bédard, N., *Evaluation of the Performance of Electric Heaters and Radiant Gas Burners,* CEA report no. 9321 U 986, 1996]. The infrared system is placed directly downstream of the coater, which allows to "seal" the coating slip on its paper support. Currently, this technique constitutes a standard since it results in an excellent quality product at high running speeds. The high power density also enables installation on existing machines, where space is limited.

Nearly all the first infrared systems mounted on coaters were electrically powered: they were essentially made of high intensity lamps (emitting a very vivid white light). But, the infrared gas technology slowly emerged and now takes an increasingly important part of the market. Today, most of the new infrared systems that are installed in the pulp and paper industry are powered with natural gas. Different technologies are available: perforated ceramic tiles, ceramic or metallic fiber matrices, reticulated ceramic and the like.

The main reason for the success of the gas infrared technology is obviously the gross price of this source of energy. The ratio between the price of gas and that of electricity in large industries is about 1 to 3 in Québec and may reach up 1 to 5 and even more in the United States. The sturdiness of gas radiation devices is also appreciated when compared to high intensity lamps, which are reputed to be quite fragile.

Often, the higher cost for electricity as compared to gas is compensated by a better efficiency of electrical technologies. If one considers the radiation efficiency only, i.e. the total radiation power versus consumed power, one could conclude that this is the case in the field of infrared applied to the pulp and paper industry. Indeed, this efficiency is typically 80% for short infrared units and 45% for gas radiation devices. These values were precisely measured during tests performed within the framework of an important project of the Association Canadienne de Électricité (Canadian Association of Electricity)[idem]. However, this efficiency does not account for what takes place at the paper level, because the really useful part of the consumed power is what is actually found inside the coated paper. The optical properties of the paper and the coating slip should therefore be taken into consideration. But these properties vary accroding to wavelength range.

The temperature of gas emission radiating systems is between 900 and 1150° C.: radiation is therefore of the medium wavelength range, i.e. within the wavelengths identified at medium infrared (more than 85% of the power radiated between 1 and 6 $\mu$m). They present radiation power densities of 100 to 160 kW/m$^2$. Lamp type electrical heaters (in which the filament reaches 2200° C.) provide more radiation within the short wave infrared (more than 85% of the power radiated between 0 and 2.5 $\mu$m) and yielding power densities exceeding 300 kW/m$^2$.

It is generally recognized that medium wavelength infrared is better adapted for drying paper and coater's coating slip because of the appropriate coupling of their spectral optical properties and the emission spectrum [Pettersson M., Stenstrom S., *Absorption of Infrared Radiation and the Radiation Transfer Mechanism in Paper, Part II. Application to Infrared Dryers.,* Journal of Pulp and Paper Science: Vol. 24 N° 11, November 1998]. The advantage of a better radiant efficiency of lamp type electrical systems is therefore diminished, and consequently also that of the power density.

The obvious solution to this problem is of course a medium wavelength electrical infrared (that is with a radiation temperature around 1100° C.), already commonly used in many fields (textile, plastic, agro-food). However, the current technology does not permit to reach the same radiation power density as that of gas radiating systems: at the most 80 kW/m$^2$ with an electrical system compared to 150 kWm$^2$ with a gas system. This lack of competition for medium wavelength electric radiation systems leaves the door wide open to gas systems. In fact, gas technology is holding the market of infrared drying in the pulp and paper industry in North America (300 MW in 1995) and in the world (more than 1000 MW). An electrical infrared technology allowing power densities that are equivalent to gas radiating systems within the medium range infrared would therefore be welcome. Moreover, the market's requirements are for ever increasing power densities: the emergence of a medium wavelength infrared electrical technology operating at very high power density would open particularly attracting horizons. The availability of such a technology would be even more interesting since gas radiating systems efficiency decreases with temperature emission, and therefore with the power density, in an inextricable manner [Douspis, M., Robin, J. -P., <<Les brûleurs radiants à gaz>>, document CERUG 86.05]. An electrical technology having a radiating power density over 200 kW/m$^2$ would then be very competitive (at an equivalent power density, gas radiating systems have a radiant efficiency of less than 35%).

As will be explained, the current electrical medium wavelength infrared technology is limited in power density and an object of the present invention is therefore to overcome these limitations.

Typically, an infrared source consists of a solid body that is raised to such a temperature that it emits an electromagnetic radiation of the infrared type. Electrical infrared heaters imply the passage of a direct current through a resistance, normally a metallic wire. Heating is therefore carried by Joule effect (direct electrical conduction).

The power density of a heater comprising a metallic wire is limited for many reasons. Metallic wires have a low electrical resistance and cannot be used at a temperature exceeding 1300° C. To obtain an adequate resistance (i.e. sufficiently high to provide acceptable currents), the diameter should be decreased or the length of the wire should be increased. The wire's life span is therefore decreased as its diameter decreases: consequently, it is better to increase the length of the wire, which is obtained by making a coil. But then, a certain distance between the spires of the same coil and the rows of coils must be maintained to limit occurrence of hot points. This requirement limits the power density.

Moreover, it is often essential to cover the coils with an insulating material protecting them from the environment, both thermally (in order to limit the losses by convection with ambient air) as well as electrically (for reasons of security). The coiled wires are then embedded or inserted in a material that is transparent or not to infrared radiation.

When dealing with a material that is opaque to infrared, heat must be transmitted from the internal metallic wire to the external sheath by direct conduction. It is then this sheath that emits infrared radiation and it equilibrates at a lower temperature than the internal wire itself. In the case of radiating tubes ("tubular heaters"), an non-conductive material (normally an oxide) must be inserted between the resistance and the sheath, which limits heat transfer and produces a high temperature gradient. The power density is thus more limited than with a naked coil.

When a material transparent to infrared (normally quartz) is used to contain the coil, radiation originates from the coil itself but passes directly through the quartz. The metallic coil is then protected from movements of surrounding air: losses by convection are thus decreased. The power density of infrared sources consisting of coiled wires embedded in quartz plates or inserted in quartz tubes is the highest among the electrical medium wavelength infrared sources but remains below 100 kW/m$^2$, providing less than 80 kW/m$^2$ of radiation.

On the other hand, short infrared lamp sources are characterized by a very high power density, since the tungsten wire inside the lamps is raised to very high temperature (2200° C.): as seen above, this level of temperature implies that the emission of the short wavelength type, causing the already mentioned disadvantages. Moreover, the tungsten wire should be enclosed in a sealed tube to prevent a rapid oxidation thereof.

It should be noted that among all metals, no current technology allows to exceed 1300° C. in an oxidizing atmosphere for a very long period of time (in terms of years). The only metallic alloy that maintains relatively well this level is made of Iron-Chromium-Aluminum and is mainly manufactured by the Kanthal Company (under the name Kanthal Al). In fact, its mechanical properties are much weakened at that temperature.

Another means for increasing power density is to enlarge the real emission surface by utilizing an expanded surface instead of a coiled wire. A configuration in the form of a full and expanded plate enables to increase the emission surface. In theory, if it would be possible to heat a full surface of Kanthal Al at 1300° C. in a relatively uniform fashion, the radiation power density would be very high (above 300 kW/m$^2$). The difficulty is to force the current to pass everywhere over this surface. While using direct conduction, it is very difficult to produce uniform heating, since current passes through the shorter "electrical" path. In order to make the current pass everywhere between the voltage terminals, several gaps must be made in the plate, which cause mechanical weaknesses and local current concentration problems. Some means have been evaluated and tested by the Applicant, but several problems have lead to question the use of direct electrical conduction: heating uniformity, voltage supply, thermal expansion, mechanical solidity, thermal losses through contacts, and more.

Following the above considerations, Applicant has considered using electromagnetic induction: instead of passing current directly through a resistance, heating can then be carried by Foucault currents induced by a conductor that is physically separated from the heated material. Moreover, the material in which these currents are produced may be another material than the metal constituting the coiled wire of conventional infrared sources.

The use of induction instead of direct conduction therefore allows to solve many technical problems.

The choice of the material the emitting surface is made of constitutes the determinant aspect. This material should have the capacity to support very high temperatures, well over the Curie point of all the materials having magnetic properties. Therefore, only resistance plays a part in an electromagnetic point of view. Furthermore, Applicant has managed to identify a range of material electrical resistivity and of supply frequencies leading to an excellent electrical yield and a good power factor, two conditions necessary to use the induction as heating mean for an infrared system. It is possible to transfer a very high power (over 50 kW for a 0.16 m$^2$ plate) by generating a typical electrical field, at a reasonable voltage supply. Heating is relatively uniform, in spite of the fact that the current produced in the heating plate takes the form of the inductor's configuration, the latter being in the circular shape ("pancake"): the four corners of the plate are therefore colder, as well as the center. However, this concept enables to prevent problems associated with hot points and losses through the connections associated with direct electrical conduction.

The material the emitting surface is made of should have the capacity to support very high temperatures and thermomechanical stresses. The metals the resistance wires of the infrared sources are made of are characterized by very weakened mechanical properties, in the vicinity of 1300° C., which would prohibit them form being used as radiating plate.

A solution that was studied consisted in using electrically conducting ceramic, namely silicon carbide of the "reaction bounded" type. Some variants of this material contain a portion of free silicon allowing an electromagnetic induction heating at a few tens of kilohertz. Induction heating of one square foot plates has shown a good electromagnetic coupling, but has systematically led to thermomechanical breaks. It appears that monolithic type ceramic materials are not suitable: on one hand because thermomechanical stresses produced by an intense and imperfectly uniform heating are in the order of their ultimate mechanical resistance; on the other hand, the currently known processes of manufacturing large plates of monolithic ceramic material produce important residual stresses.

Finally, Applicant realized, as well as others, that even the strongest ceramics, such as silicon carbide, are fragile to mechanical and thermomechanical stresses.

A relatively recent solution to this traditional problem consists in blending fibers in the ceramic matrix, in order to constitute a <<Ceramic Matrix Composite>> (CMC). The fact of incorporating fibers allows to increase the material strength and to eliminate all danger of break due to a catastrophic process: fibers prevent rapid development of microcracks [Wess J. K., *Breaking Tradition With Ceramic Composites Offer New Features that Traditional Ceramics Lack*), Chemical Engineering, pp 80–82, October 1996].

In an improvement effort, some years ago, a particular type of ceramic composite was developed, i.e. the "Continuous Fiber Ceramic Composites" (CFCC), manufacturing of which implies techniques such as CVI (Chemical Vapor Infiltration) and CVD (Chemical Vapor Deposition).

CFCC's therefore constitute a solution to the traditional problem of ceramic material fragility. They can operate at high temperature, be subject to thermal stresses, and have an important life span. These advantages make them ideal candidates to be used on the basis of a high power density infrared system. However, most of the CFCC's are not electrically conductive, and cannot therefore be heated by electromagnetic induction. Applicant has noted that CFCC's which contain carbon fibers (C/SiC) are sufficiently electrically conductive to be efficiently heated by electromagnetic induction.

Moreover, other materials that are continuously being developed are carbon/carbon composites that also have a very high resistance to thermal stresses. They are however limited in terms of temperature since they are oxidized above 600° C. They must therefore be covered with an external protective layer, which is the object of many studies throughout the world. Applicant has verified the excellent response to heating by electromagnetic induction of a C/C plate that is covered with a layer of silicon carbide.

However, the performance of the anti-oxidizing layer under high temperature of the C/C composites for a prolonged period of time (years) remains a technological problem up to now [Bédard N., *Développement d'un émetteur infrarouge à haute densité de puissance—Rapport d'activités* LTEE-RT-0096/1998]. A solution to this problem would open the door on vast horizons, since the C/C composite itself maintains excellent mechanical properties, even above 2000° C. This temperature would involve power densities exceeding a thousand kilowatt by square meter!

DISCLOSURE OF THE INVENTION

An object of the invention is to produce a radiating surface that is merely made of a suitable material, having the appropriate shape and size, and which electrical, mechanical and thermal characteristics as adequately selected.

Another object of the invention is to rely on induction, which allows to use non-metallic materials, and to obtain a good electrical yield.

It is another object of the invention to reach a limit temperature that is higher than that of Fe—Cr—Al base metals, which is 1300° C., and can even exceed 1400° C.

Another object of the invention is to use a composite material having a relatively low electrical resistance as to respond to induction heating.

Another object of the invention is to reach power densities of more than 200 kW/m$^2$ in medium wavelength infrared by utilizing a heater according to the invention.

It is also an object of the invention to use a material that responds to electromagnetic induction and having the capacity to support the operating conditions above-mentioned, for example responding to induction heating.

Another object of the invention is to propose as a material for the heater, composite ceramics that do not have the disadvantages of monolithic type ceramic materials.

In order to overcome the disadvantages described above, Applicant has provided an infrared heater comprising a surface consisting of a material responding to induction and able to support high temperatures, at least one layer of insulating material of very low heat conductivity opposite said surface, an inductor adjacent said insulating materials layers and separated from said surface by the latter, as well as one field concentrator adjacent to said inductor. The material responding to induction may for example consist of a matrix enabling induction heating and including carbon fibers.

According to a preferred embodiment, the surface reacting to induction is in the form of a plate that can be selected from composite materials namely CFCC and carbon/carbon type.

According to another preferred embodiment, the surface should have the capacity of being heated to a temperature of at least 1300° C., and to produce a radiation power density exceeding 250 kW/m$^2$.

According to another embodiment, the insulating material consists of a layer of low temperature insulating material and a layer of high temperature insulating material.

Then, the inductor may include an inductor consisting of a water cooled copper tube, or it may also include Litz cables.

According to another embodiment, the field concentrator is opposite the inductor.

According to a practical application, the plate has a layer between about 1 mm and 5 mm.

BRIEF DESCRIPTION OF THE INVENTION

Figure 2:
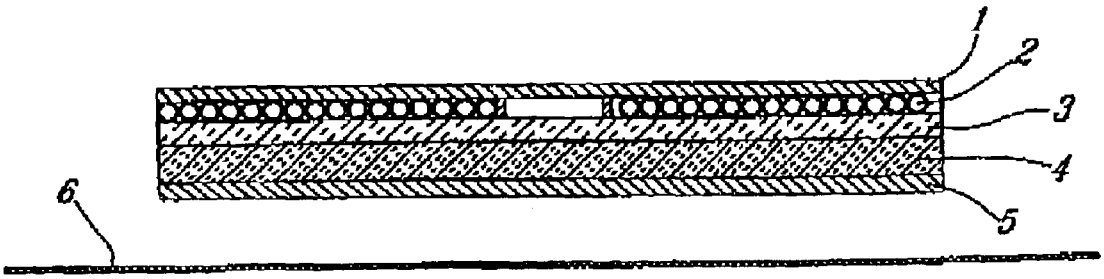

Other characteristics and advantages of the invention will appear from an embodiment that is illustrated in the annexed drawings, in which FIG. 1 is a plan view of an infrared induction heater, according to the invention, and FIG. 2 is a cross-section taken along A'–A" of FIG. 1.

DETAILED DESCRIPTION OF THE INVENTION

With reference to the drawings, the basic configuration of a heater according to the invention is simple as it can be seen. It comprises a plane radiating surface 5 that responds to induction and can resist high temperatures. A preferred material constituting the plane-radiating surface will be described in detail below. This plane surface is opposite a high temperature insulating material 4. Above this high temperature insulating material 4, there is a low temperature insulating material 3. It is understood that the nature of the insulating materials 3, 4 will vary according the needs and the particular choice of the constituting materials will be left to one skilled in the art. On the other side of the two insulating materials 3, 4 there is an inductor 2 consisting, in the illustrated case of a water cooled copper tube, well known to those skilled in the art. A Litz cable or any other inductor could also very well be used, depending on the choice of one skilled in the art. The inductor is coiled upon itself in a plane. Finally, a field concentrator is mounted opposite the spiraled tubular member (FIG. 1). As will be seen in FIG. 2, the infrared heater is mounted to transmit a radiation on a sheet of paper 6.

Applicant has discovered that a CFCC comprising carbon fibers enables to get an extended plate at high temperature to produce medium wavelength infrared radiation with a high power density. Tests have shown that the carbon fibers that are incorporated within a silicon carbide matrix produce induction heating at frequencies of some tens of kilohertz. Simulation tests and tests made on a prototype have shown that it would be possible to transfer the power with a very good electrical efficiency. It was possible to observe that this composite has excellent thermomechanical properties. A plate made of CFCC of AlliedSignal Composites had a perfect plane aspect and a good appearance of uniformity. A very intense induction heating led to no breaks, deformation nor reduction of mechanical rigidity. Electromagnetic coupling was also confirmed to be excellent.

To summarize, the invention consists in heating a plate of a specific material by electromagnetic induction, said plate being heated at high temperature, and consequently, produces an infrared radiation. The main temperature of the plate is about 1300° C., which constitutes a source of medium wavelength infrared, therefore suitable for drying a coating on paper. At that temperature, and taking into account the emission capacity of the constituting material, the radiation power density exceeds 250 $kW/m^2$, which would more than double the radiation power density of most presently known radiant gas burners.

This very high power density constitutes a very desired aspect of such a system. This represents an occupied surface that is reduced by half for the same power provided therein. Moreover, the concept is characterized by a very reduced vertical crowding as compared to currently know gas and electrical technologies: this is due to the absence of air combustion and gas inlets (with reference to gas radiating means) or cooling air for the connectors (with reference to the short infrared lamp technology). The new concept therefore makes it possible to reduce the space that is occupied horizontally and vertically. The reduced vertical crowding may allow placing HDIR (High Density InfraRed)/induction sources on both sides of the sheet of paper, which would increase even more the power density.

In addition to the pulp and paper industry, the HDIR technology could also find very interesting applications in metallurgy and glass making. In metallurgy, high temperature ovens, that are presently heated with radiating tubes, could advantageously be replaced by means of induction heated plates. These plates could then be mounted against the internal walls of the oven to give a very high heating capacity, and production. In the glass industry, high power density of infrared in the medium wavelength range is also greatly desired.

What is claimed is:

1. Infrared heater comprising a surface consisting of a material responding to induction and capable of withstanding elevated temperatures, at least one layer of insulating material of very low heat conductivity placed against said surface, an inductor adjacent said layers of insulating material and separated from said surface by said layers, and a field concentrator adjacent said inductor, whereby said surface produces high power density infrared radiation when heated at said elevated temperatures by electromagnetic induction.

2. Infrared heater according to claim 1, characterized in that the surface that responds to induction is in the form of a plate.

3. Infrared heater according to claim 2, characterized in that said plate is selected among composite materials.

4. Infrared heater according to claim 3, characterized in that said plate is selected from composite materials of CFCC and carbon/carbon type.

5. Infrared heater according to claim 4, characterized in that said plate has a thickness between 1 mm and 5 mm.

6. Infrared heater according to claim 3, characterized in that said surface is capable of being heated to a temperature of at least 1300° C., and to produce a radiation power density exceeding 250 $kW/m^2$.

7. Infrared heater according to claim 6, characterized in that the field concentrator is mounted adjacent said inductor.

8. Infrared heater according to claim 3, characterized in that said plate is selected from composite materials of CMC type.

9. Infrared heater according to claim 2, characterized in that said plate has a circular shape.

10. Infrared heater according to claim 1, characterized in that the surface responding to induction is a thin layer placed against a plate.

11. Infrared heater according to claim 10, characterized in that the inductor includes a water cooled copper tube.

12. Infrared heater according to claim 10, characterized in that the inductor comprises a Litz cable.

13. Infrared heater according to claim 1, characterized in that the insulating material consist of a layer of a low temperature insulating material and a layer of a high temperature insulating material.

14. Infrared heater according to claim 1, characterized in that said material consists of a heating matrix and comprising carbon fibers.

15. Infrared heater according to claim 1, characterized in that said infrared radiation has a medium wavelength range which is comprised between 1 and 6 $\mu$m.

* * * * *